US005403269A

United States Patent [19]

Kennedy

[11] Patent Number: 5,403,269

[45] Date of Patent: Apr. 4, 1995

[54] ADJUSTABLE CERVICAL TRACTION APPARATUS

[76] Inventor: Jay M. Kennedy, RD #2 Box 261A, Friedens, Pa. 15541

[21] Appl. No.: 102,249

[22] Filed: Aug. 5, 1993

[51] Int. Cl.[6] ..... A61H 1/02

[52] U.S. Cl. ..... 602/36; 602/32; 482/122; 482/128; 482/908

[58] Field of Search ..... 482/10, 121, 122, 128, 482/129; 606/240; 602/32, 33, 35, 36, 40, 18

[56] References Cited

U.S. PATENT DOCUMENTS

| | | | |
|---|---|---|---|
| 3,228,392 | 1/1966 | Speyer | 482/122 |
| 4,695,049 | 9/1987 | Ciemiega | 482/128 |
| 4,777,678 | 10/1988 | Moore | 606/240 |
| 4,834,366 | 5/1989 | Hotchkiss | 482/122 |
| 5,005,826 | 4/1991 | Merrick | 482/10 |
| 5,071,119 | 12/1991 | Johnson | 482/128 |

FOREIGN PATENT DOCUMENTS

| | | | |
|---|---|---|---|
| 8700424 | 1/1987 | WIPO | 602/32 |

OTHER PUBLICATIONS

Advertisement for "Comfort Wedge" by Comfort Products received Nov. 7, 1983.

*Primary Examiner*—Richard J. Apley
*Assistant Examiner*—Jeanne M. Mollo
*Attorney, Agent, or Firm*—John P. Halvonik

[57] ABSTRACT

A two-part traction device for applying caudal pressure against the forehead of the user comprising a first part back support and a second part, or traction unit. The user lies with his neck extended over the padded back support which supports the thorax of the patient in a face up position. The second part, or traction unit, comprises a spring loaded tube which is used to apply the compressive force against the user's forehead in this position. The traction unit has a bowl shaped forehead engaging member with a padded material portion for engagement with the forehead. The force applied to the user may be varied by rotation of the spring loaded tube by various degrees thus elongating the spring tube and increasing the pressure transmitted through to the headpiece.

1 Claim, 3 Drawing Sheets

ADJUSTABLE CERVICAL TRACTION APPARATUS

BACKGROUND AND PRIOR ART

The invention relates to the field of orthopedic devices and in particular, to a traction device for providing pressure downwardly on the skull for maximum extension of the neck. The unit is designed to reproduce at home, the forces used in clinical research on cervical curve restoration. The device is meant to be inexpensive and able to be used at home by the patient in a vast array of places. Typical usage would be with the patient lying supine with back upon the support block and the traction unit against a wall or other vertical standing structure. The device can restore skull thorax positions without resort to facilities in the office.

The device is able to supply a force to the neck that may be gradually increased or decreased throughout the stretch. It is believed that this addresses the "time dependent" component of spinal posture alterations by a compressive traction force that is delivered to the forehead by a spring loaded and wall mounted device while the thorax is elevated into flexion with the skull fully extended.

In this position, pressure on the forehead eliminates jaw stress and allows unencumbered extension with compression to get a strong tissue stretch. The supine positions and the body support member provide improvement of lateral thoracic and lumbar alignment problems.

The traction unit comprises two tubes with a threaded rod that telescopes inside the tubes for extension. It is believed that the use of the threaded rod allows for gradual increase of the skull extension compression stress while tractioning is going on. The use of a threaded rod also allows for some initial misplacement of the patient visa vis the wall during the initial fitting of the device. For example, as the patient lies down initially, the traction unit is placed between the forehead and a wall-there may be several inches of space between the forehead and the wall. This space may then be bridged by rotation of the tubes which extends them to reach the forehead.

Prior art devices usually have the patient lying down with a harness in connection with weights. Disadvantages to this method include: the necessity of requiring a table or bench; and a large force is added to the underside of the chin which stresses the TMJ (jaw joint) and has been shown to cause problems in that area. The weight used could slip and cause injury to the patient. Poor compression of the skull may result as the harness' main pressure is under the chin and, as this force is applied in a straight line, compression of the skull posterior may not be achieved. Of course, this compression is the major goal of of clinical research extension traction procedures.

Moreover, the weight(s) used in such a system provide a constant force which cannot be varied unless one interrupts the traction. By contrast the applicant's invention allows the force applied to be varied as the user remains in position. In fact, the adjustment means on the tractioning unit allow the patient himself to change the force.

The use of sit down devices cannot mechanically address the thorax extension or posterior translation which nearly always occurs with loss of cervical curves. Also, seated traction devices are very uncomfortable and precludes improving lumbar problems. There are no known devices that place the neck in this outstretched position. The use of the body support member translates and flexes the thorax anterior. It is believed that this flexing helps address the cervicothoracic and thoracolumbar spinal regions.

SUMMARY OF THE INVENTION

The invention is a two part traction device designed primarily for applying compressive force against the neck thereby compressing the skull via the forehead into a full, unencumbered extension. The first part of the device, or the padded body support provides a curved member for supporting the body of the patient primarily in the face-up position. The second member or traction unit provides a readily reproduceable force by means of a spring loaded tube system. The upper part of the traction unit has a bowl shaped forehead engaging member of padded material for engagement with the forehead. One of the tubes has a spring inside so as to provide a force against the forehead through the forehead engaging member. This force may be varied by rotation of the lower tube so as to vary the combined length of the two tubes and thus the tension supplied on the neck.

Another object of the invention is to prevent the development of TMJ problems in traction patients.

Another objective is to provide a traction device that can readily reproduce previously applied traction forces.

Another objective is to provide a traction device that can be set up in a variety of places and whose force may be varied by the patient as he is using the device.

Another objective is to provide a traction device for placing the neck in an extended position and also to provide a force on the neck which may be continuously varied as the neck gradually loosens during traction and thus becomes able to handle greater extension.

Other objectives of the invention will become apparent to those skilled in the art once the invention has been shown and described.

DESCRIPTION OF THE PREFERRED EMBODIMENT

Figure 1:
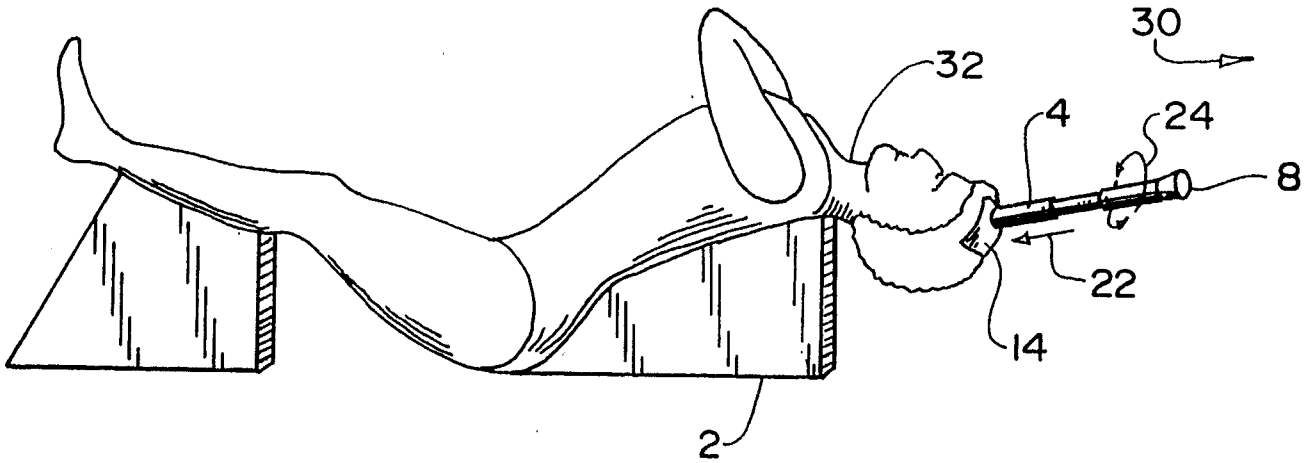
FIG. 1 The apparatus in use.
Figure 3:
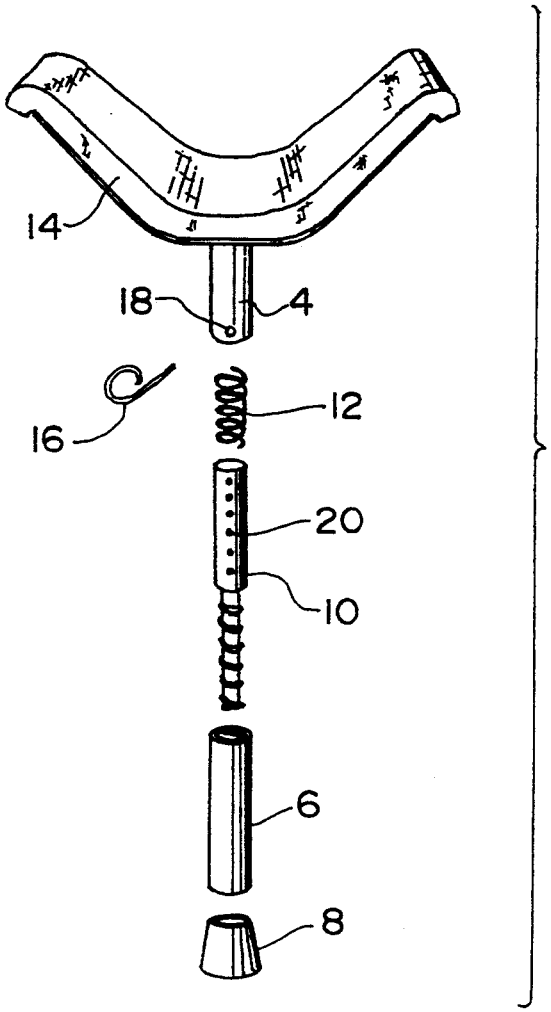
FIG. 3 Break apart view of traction unit.

The body support member is shown as 2. It is of shape to flex the thorax and translate it anterior as one lies in the face up position. In this position, the neck 32 is extended backward over the edge of the support member 2 and the thorax flexes superior, see FIG. 1.

Figure 5A:
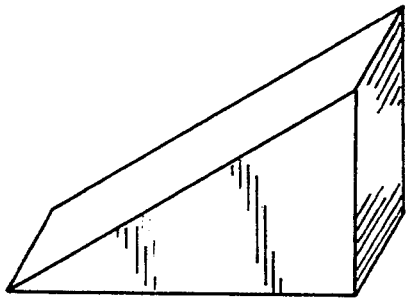
FIG. 5 Alternate shapes for the back suport unit.
Figure 5B:
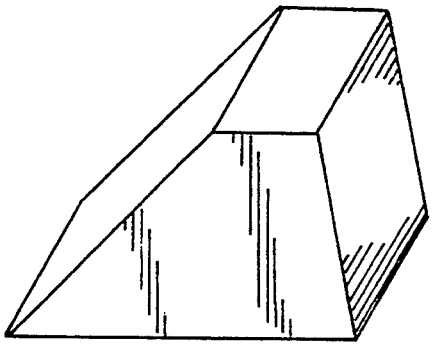
Figure 5C:
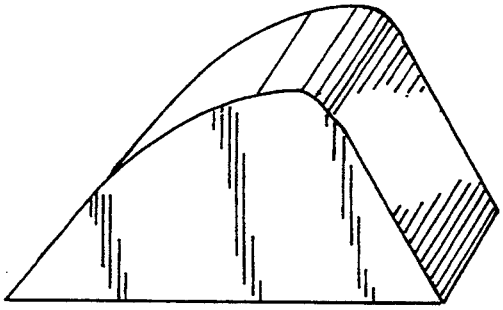
Figure 4:
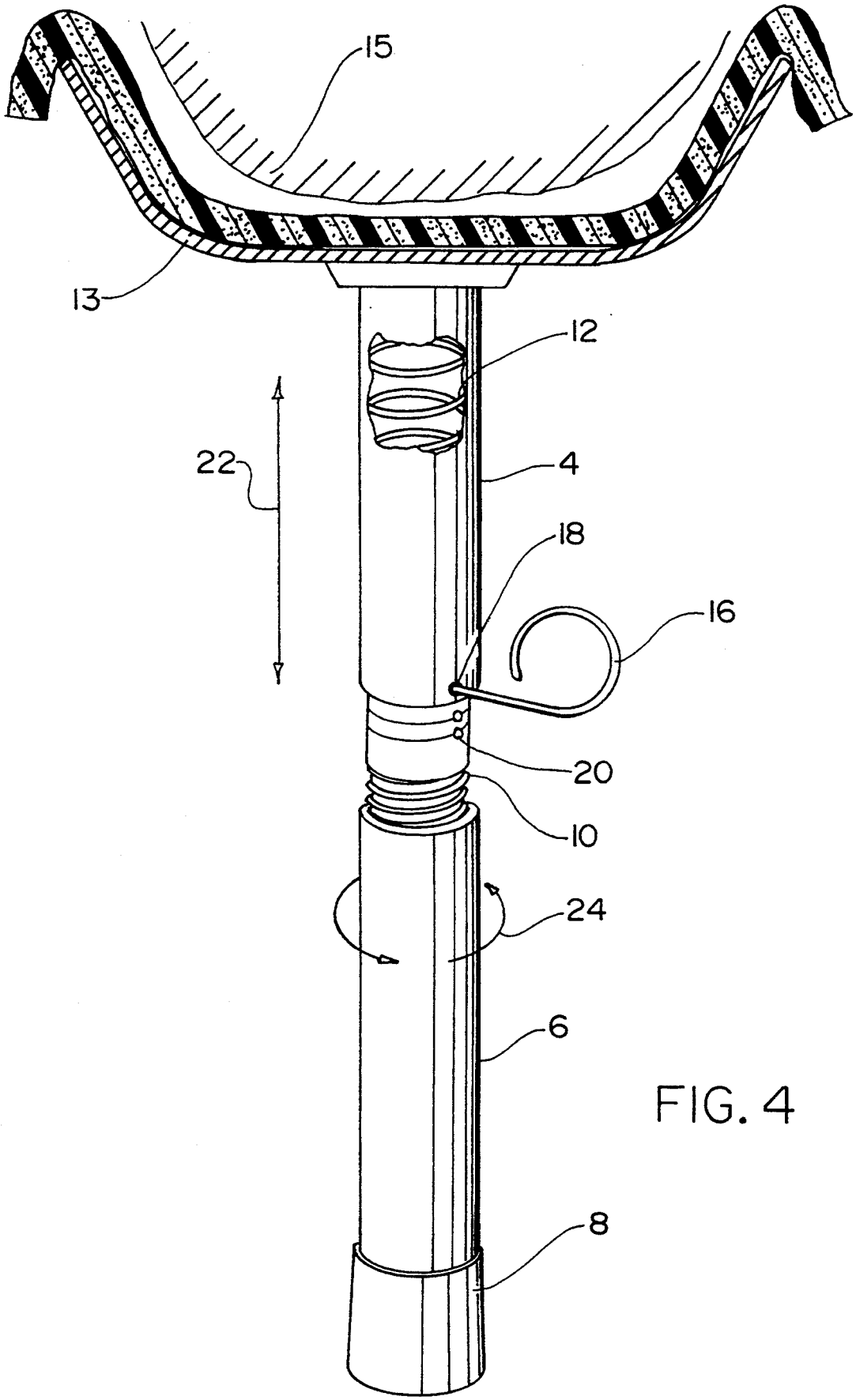
FIG. 4 Traction unit constructed.

The body support member should be made of resilient material e.g. foamed polymeric material, for example: medium density, open celled, polyethylene. It is thought that the block should be about 12–14" in width and about 14–16" in depth. The support may come in various shapes shown in FIG. 5. 5A illustrates a "wedge" shape, having a triangular cross section and in the shape of a wedge. FIG. 5B shows a pyramidal shaped support member having four sides and trapezoidal side section. FIG. 5C shows a roughly half moon shape. Any and all of which shapes may find utility in this invention.

The traction unit comprises two tubes-a lower tube 6 and an upper tube 4 which are engaged to one another by means of a threaded rod 10. It is preferred that the tubes be of a larger diameter than the rod in order that the rod may lie inside the upper tube and thread into the bottom tube. The upper tube has a hollow interior portion which contains a means such as a compressive spring 12 that supplies force from the rod through the forehead engaging member 14 in turn, to the skull. The spring should be of the type whose force increases as it is compressed.

The tension of the spring may be adjusted by turning of the lower tube in relation to the inner rod (assuming the position of the outer tube vis a vis the lower tube remains the same. Various springs with differing compressive force may be used in the unit for different applications. At the bottom end of the lower tube is placed a rubber "foot" 8 which provides a frictional grip against vertical surfaces such as a wall 30. The tubes should be made of rigid material such as ABS (Acrylo butadienyl stryene) plastic or PVC (polyvinyl chloride). The preferred length of the tubes would be about 5–8" in length and about ¾" in diameter.

The relation of the two tubes to one another may be determined by a pin 16 set through an aperture 18 in the base of the upper tube and inserted into one of several apertures 20 in the rod as it lies within the upper tube. The pin will prevent the tubes from moving in relation to one another before the patient is ready for the traction to be applied.

In this manner, the traction unit may be placed in position for the patient without immediately applying the force from the spring as the pin holds back the tube. The holes may be placed in the rod at, say, ½" intervals. This, so that the two tubes may be joined in relation to one another through the holes via pins or other means. Thus, the compressive force in the spring maybe set at different, predetermined levels via the placement of the pin the holes 20 and, thus, that particular force previously supplied to the head may be reproduced.

The upper tube of the traction unit is attached to the forehead engaging member 14 and is of bowl shape for contact with the skull. It may have a base member 13 of rigid material like the plastic used on the tubes but should be covered with a padded material 15 for comfort.

To place the apparatus in use the patient lies on the support member with back against the surface of the padded member. The distance the support member is from the wall (or other vertical structure) is determined by the height of the patient. It is thought that for patients 5' to 5'5" tall this distance would be about 25" and for patients, 5'5" to 5'8" the distance is 26", for patient 6', the distance is 27", etc. Other distances are possible without varying from the spirit of the invention.

As the patient lies face up the top of the support block should impact against the "comfort zone" of the mid-scapular region. The head should extend backwards without hitting the floor and without hitting the block.

Before the patient lies back the user should select the pressure to be provided on the skull by approximating the tubes in relation to one another and then pre-selecting this distance by insertion of the key (which may be e.g. a metal pin) into the hole 18 and one of the holes 20 in order to provide a tube assembly length that appears proper for that particular patient. The bottom of the lower tube is placed against a wall or other vertical surface where the foot 8 fits against the wall. Probably, the traction unit should extend in the downward direction (direction shown by arrow 22, this is also the direction of the traction force) toward the patient's forehead. Also a small cup-shaped receptacle to be attached to the wall could be used to accept the 'foot' and allow more consistent reproducible wall positioning.

The patient, having lain back so that the forehead engaging piece abuts the forehead, allows the traction process to begin. The force of the spring is then released by removing the pin from the tubes, a preset amount of pressure is applied against the neck of the user through the forehead. This pressure may be varied by the patient as he is lying back by simply rotating in the direction of arrow 24 the bottom tube which applies greater or lesser pressure by changing the extended length of the spring inside the tube assembly. This change in length will increase or relax (decrease) the spring tension inside the tubes accordingly.

The particular amount of force supplied may be measured by means of graduations located on one of the tubes. Preferably, the graduations would be on the rod that telescopes into the lower tube as the rod has holes corresponding to poundage levels. Markings would indicate the pressure in appropriate units as the pressure applied by the spring would vary inversely in proportion to the length of the spring.

Figure 2:
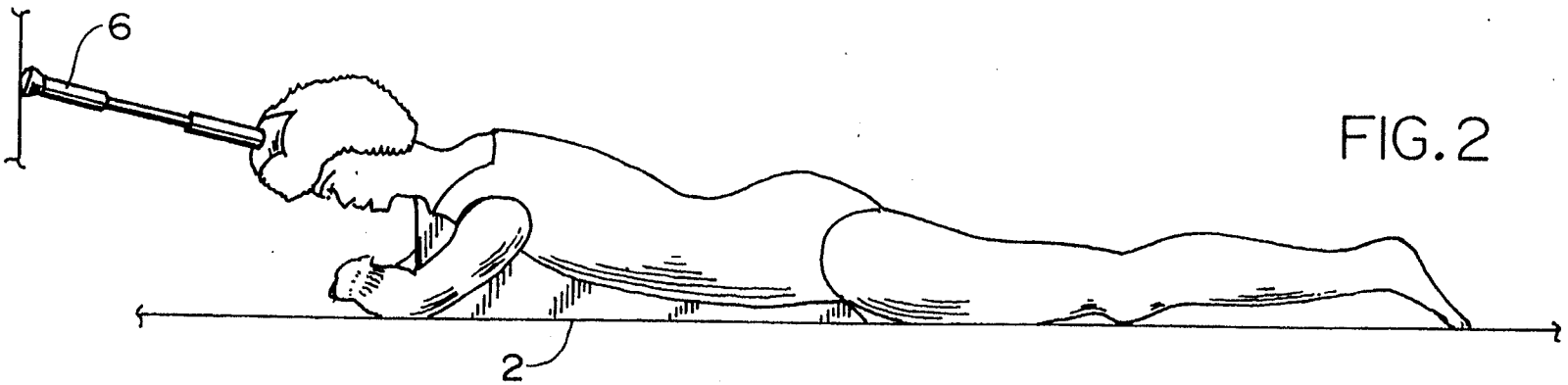
FIG. 2 Alternate face down body position.

In the alternate use, see FIG. 2 the patient may lie face down with chest against the support member. The forehead piece would be against the patient's forehead and applies pressure forcing the head caudal from a point on the wall. This position should provide full extension and posterior compression of the skull but does not allow efficient thoracic flexion and anteriority as does the supine position.

I claim:

1. A traction apparatus for providing compression force against the head of a patient comprising: a bottom tube, an upper tube, a threaded rod, a resilient force supplying means for applying a force inversely proportional to its length mounted inside of said upper tube, a head engaging support in connection with said upper tube and a means for fastening, wherein said bottom tube has a threaded interior adjustably connected to said threaded rod, wherein said threaded rod has a series of apertures and said upper tube has at least one aperture so that the position of said upper tube and the bottom tube in relation to one another may be set at a predetermined distance by inserting said means for fastening through said upper tube aperture and one aperture of said series of apertures in said rod and wherein said force supplying means is mounted between the head engaging support and the threaded rod whereby the user pre-selects the desired force by adjusting the predetermine distance between the upper and bottom tubes before lying on his back, lies on a support surface on his back, places the bottom of said bottom tube against a fixed vertical surface, engages his head against the head engaging support, removes said pin to apply the desired traction force and adjusts the force by rotating said bottom tube in relation to said rod.

* * * * *